US005727726A

United States Patent [19]

Lin

[11] Patent Number: 5,727,726

[45] Date of Patent: Mar. 17, 1998

[54] CASSETTE ASSEMBLY FOR A STAPLING MECHANISM

[75] Inventor: Arlene Lin, Taichung, Taiwan

[73] Assignee: Newco Pneumatic Corp., Taichung, Taiwan

[21] Appl. No.: 663,935

[22] Filed: Jun. 14, 1996

[51] Int. Cl.[6] ..... B25C 1/00

[52] U.S. Cl. ..... 227/119; 227/109; 227/120

[58] Field of Search ..... 227/109, 120, 227/119

[56] References Cited

U.S. PATENT DOCUMENTS

| | | | |
|---|---|---|---|
| 4,815,647 | 3/1989 | Chou | 227/120 |
| 5,335,800 | 8/1994 | Liu | 227/120 |
| 5,433,367 | 7/1995 | Liu | 227/120 |
| 5,615,819 | 4/1997 | Hou et al. | 227/120 |

*Primary Examiner*—Scott A. Smith

*Attorney, Agent, or Firm*—Charles E. Baxley, Esq.

[57] ABSTRACT

A cassette assembly for a stapling mechanism includes a cassette secured to the nose piece of the stapling mechanism and having a number of slots formed in one side for retaining nails. The cassette includes a groove and one or more notches formed in the bottom for engaging with a bar and the projections of the bar so as to secure the bar in place. The bar includes a longitudinal flange extended upward from one side for engaging with and for stably retaining the nails so as to prevent the bar from being easily worn out and so as to increase a working life of the cassette.

1 Claim, 6 Drawing Sheets

CASSETTE ASSEMBLY FOR A STAPLING MECHANISM

BACKGROUND OF THE INVENTION

1. Field of the Invention

The present invention relates to a cassette, and more particularly to a cassette assembly for a stapling mechanism.

2. Description of the Prior Art

A typical cassette for a stapling mechanism is shown in FIGS. 1 and 2 and comprises a body 80 including a nose piece 81 provided in the front and lower portion thereof. A cassette 82 is secured to the rear portion of the nose piece 81 and includes a groove 83 formed in the bottom portion for engaging with a bar 84 therein. A cap 85 is slidably engaged in one side of the cassette 82. A bracket 86 is secured to the rear and upper portion of the cassette 82 and is secured to the body 80 by fastening screws 87. The cassette 82 and the cap 85 each includes a number of slots formed therein for retaining the nails. The nails are slidably engaged in the slots and include a bottom tip slidably engaged with the bar 84 such that the bar 84 will be easily worn out. In addition, the bar 84 is simply adhered to the cassette 82 and will be easily disengaged from the groove 83 such that the nails will be easily jammed in the cassette 82.

The present invention has arisen to mitigate and/or obviate the afore-described disadvantages of the conventional stapling mechanisms.

SUMMARY OF THE INVENTION

The primary objective of the present invention is to provide a cassette assembly for a stapling mechanism which includes a stable configuration having an increased working life.

In accordance with one aspect of the invention, there is provided a cassette assembly for a stapling mechanism, the stapling mechanism including a body having a nose piece provided in a front and lower portion thereof and having a rear portion, the cassette assembly comprises a cassette including a first end for securing to the nose piece of the body and including a first side portion having a plurality of slots formed therein for retaining nails therein, the cassette including a bottom portion having a groove formed therein and having at least one notch formed therein and communicating with the groove, the cassette including a rear and upper portion, the cassette including a second side portion having a panel secured thereto, a bar secured in the groove and including at least one projection extended therefrom for engaging with the notch of the cassette so as to allow the bar to be stably secured in place and so as to prevent the bar from moving along the groove, the bar including a side edge having a longitudinal flange extended upward therefrom for engaging with and for stably retaining the nails in place, a cap secured to the first side portion of the cassette, and a bracket formed integral on the rear and upper portion of the cassette for securing to the rear portion of the body. The upward extending longitudinal flange of the bar is provided for engaging with and for stably guiding the nails to move longitudinally along the slots so as to prevent the bar from being easily worn out and so as to increase a working life of the bar and the cassette.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
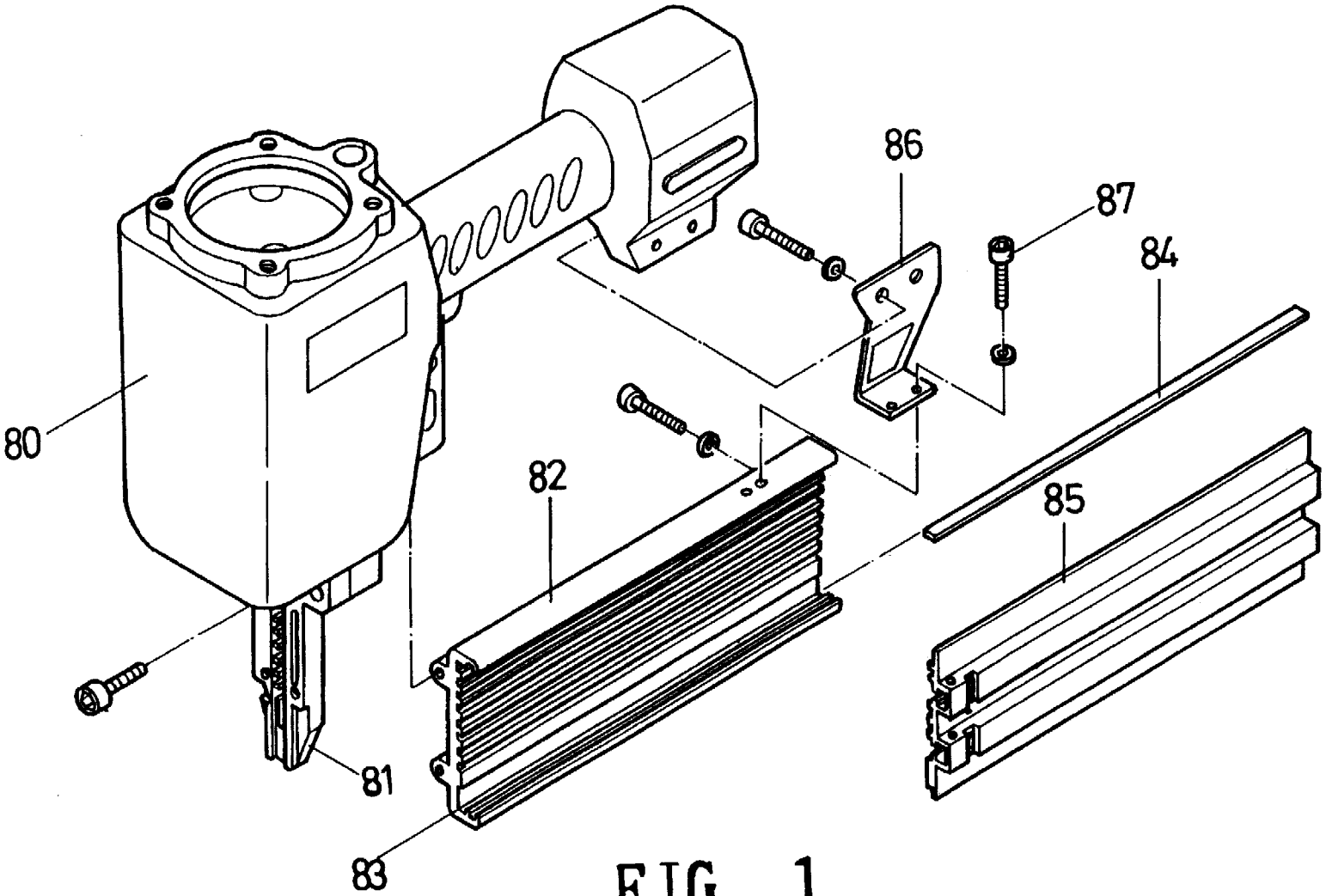
FIG. 1 PRIOR ART
FIG. 1 is an exploded view of a typical cassette for a typical stapling mechanism.
Figure 2:
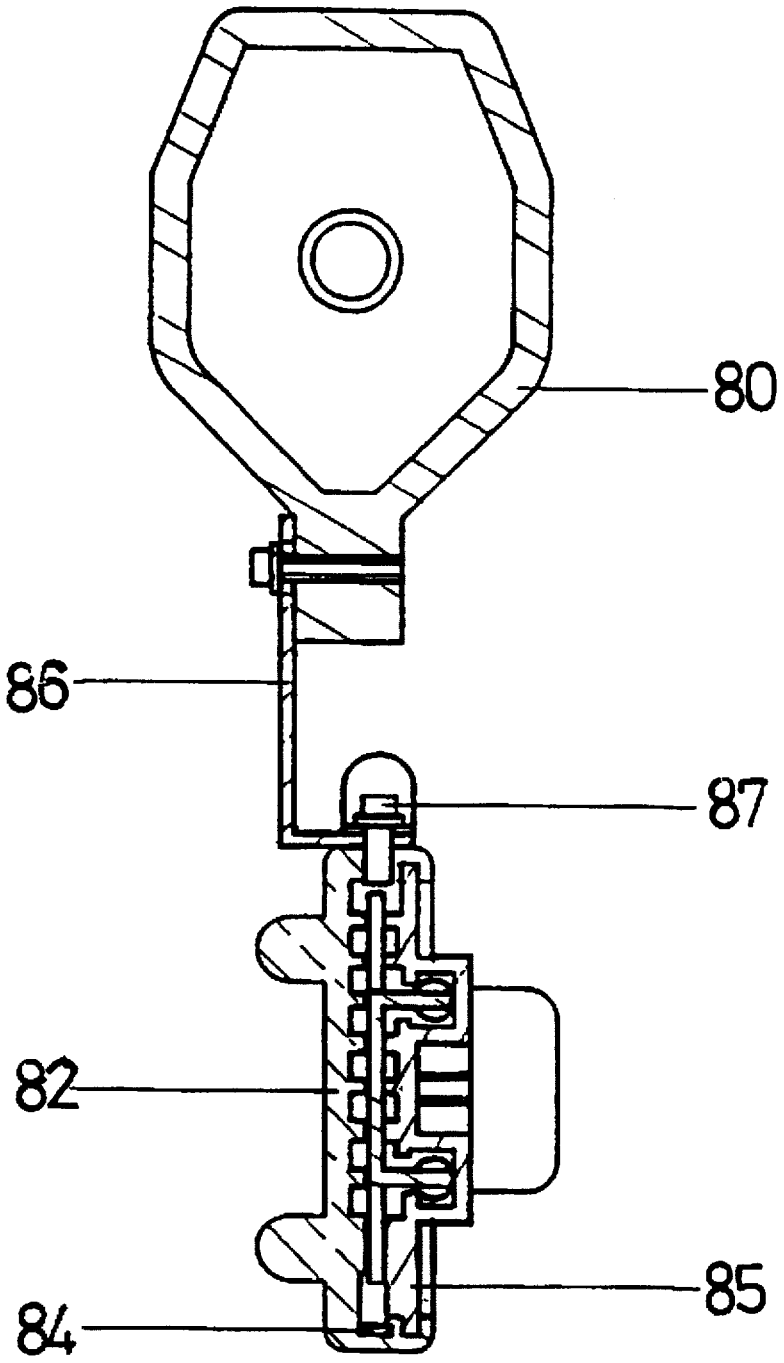
FIG. 2 PRIOR ART
FIG. 2 is a cross sectional view of the typical stapling mechanism.
Figure 3:
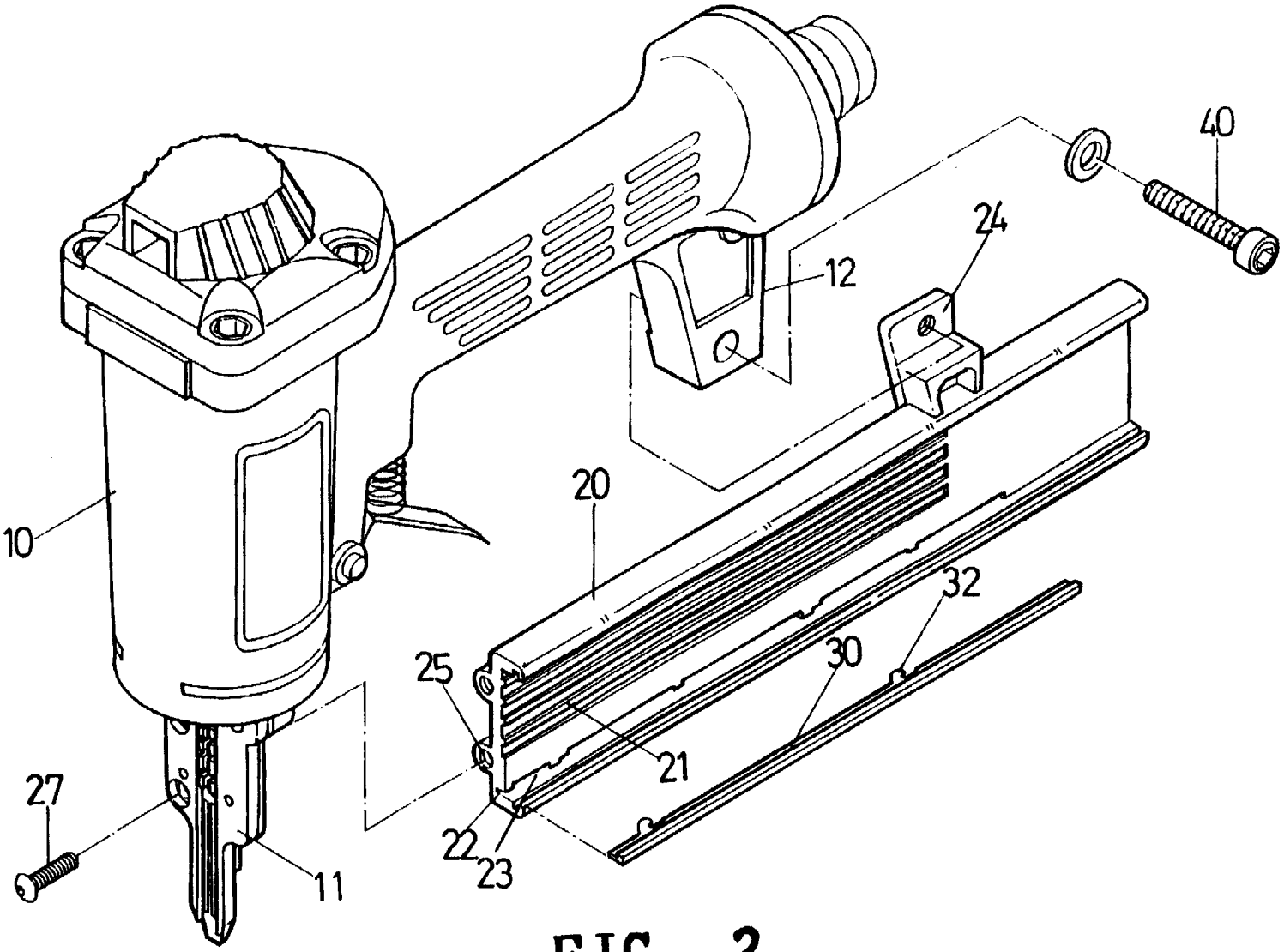
FIG. 3 is an exploded view of a cassette assembly for a stapling mechanism in accordance with the present invention.
Figure 4:
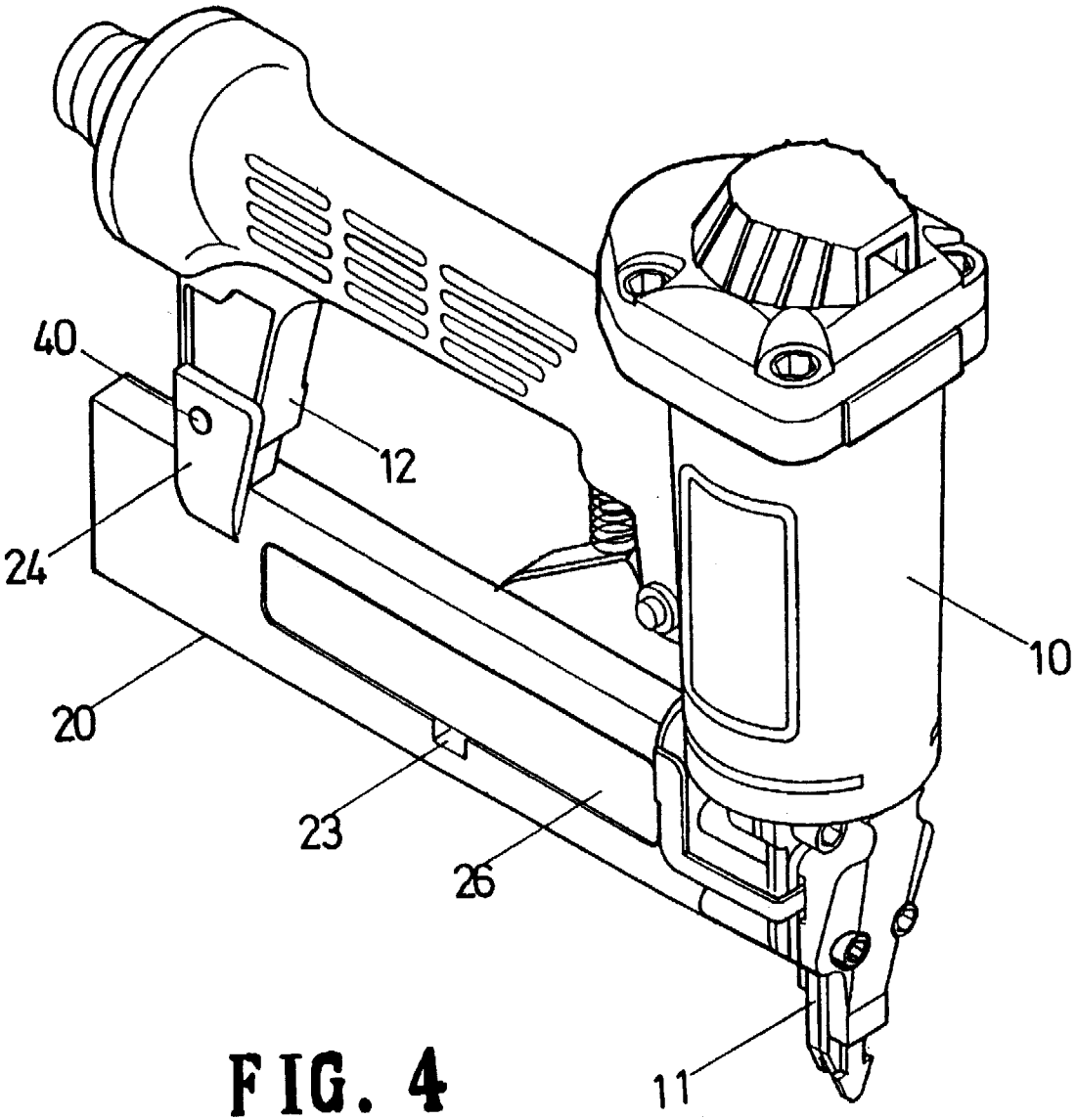
FIG. 4 is a perspective view of the stapling mechanism.
Figure 5:
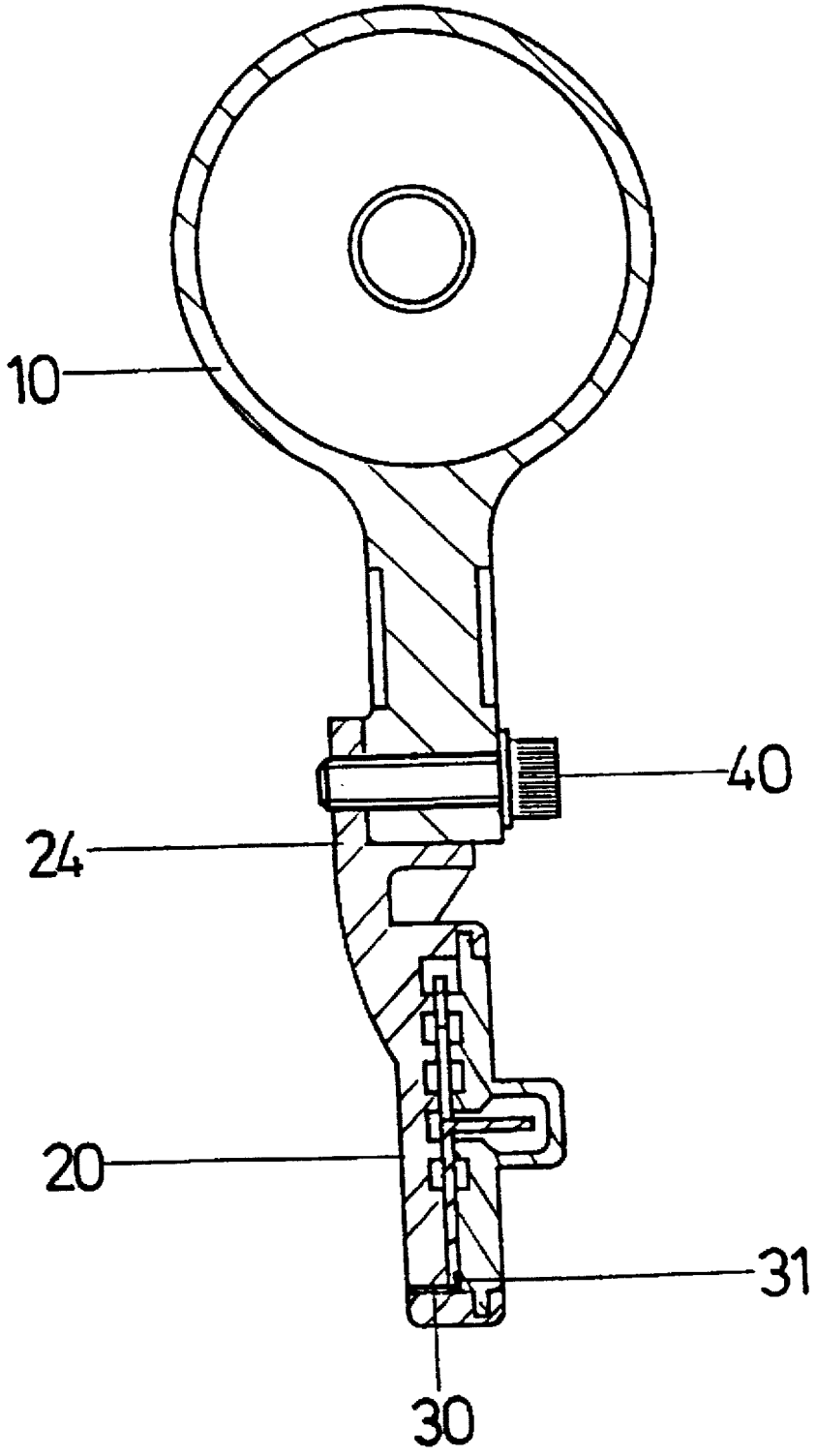
FIG. 5 is a cross sectional view taken along lines 5—5 of FIG. 4.
Figure 6:
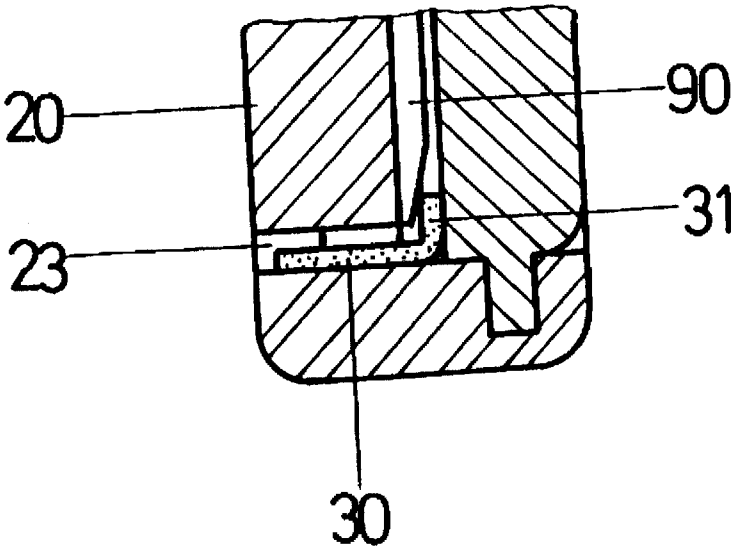
FIG. 6 is an enlarged partial cross sectional view illustrating the bottom portion of the nose piece.

Referring to the drawings, and initially to FIGS. 3 to 5, a cassette assembly for a stapling mechanism in accordance with the present invention comprises a body 10 including a nose piece 11 provided in the front and lower portion thereof. A cassette 20 includes one or more screw holes 25 formed in one end for engaging with screws 27 so as to be secured to the rear portion of the nose piece 11, and includes a number of slots 21 formed in the side portion thereof for retaining the nails, and includes a groove 22 formed in the bottom portion for engaging with a bar 30 therein. The bar 30 may be secured to the cassette 20 by adhesive material or by welding processes. The cassette 20 further includes a number of notches 23 formed in the lower portion and communicating with the groove 22. The bar 30 includes one or more projections 32 extended therefrom for engaging with the notches 23 so as to allow the bar 30 to be stably secured in place and so as to prevent the bar 30 from moving along the groove 22. The bar 30 includes one side edge having a longitudinal flange 31 extended upward therefrom, best shown in FIGS. 5 and 6, for engaging with and for stably retaining the nails 90 in place. A cap 34 is slidably engaged or secured to one side of the cassette 20. A bracket 24 is formed integral on the rear and upper portion of the cassette 20 and is secured to the rear portion 12 of the body 10 by fastening screws 40. The cassette 20 includes a recess formed in one side for engaging with a panel 26 therein for showing information of the stapling mechanism.

The bar 30 is made of wear resistive material for preventing the longitudinal flange 31 from being easily worn out and for increasing the working life of the bar 30. The longitudinal flange 31 may be stably engaged with the nails and may stably guide the nails to move longitudinally along the slots 21.

Accordingly, the cassette assembly in accordance with the present invention includes a bar that may be stably secured in place and that may be prevented from moving longitudinally along the groove of the cassette. In addition, the bar includes a longitudinal flange extended upward for engaging with and for stably guiding the nails so as to prevent the bar from being easily worn out and so as to increase the working life of the stapling mechanism.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cassette assembly for a stapling mechanism, the stapling mechanism including a body having a nose piece provided in a front and lower portion thereof and having a rear portion, said cassette assembly comprising:

a cassette including a first end for securing to the nose piece of the body and including a first side portion having a plurality of slots formed therein for retaining nails therein, said cassette including a bottom portion having a groove formed therein and having at least one notch formed therein and communicating with said groove, said cassette including a rear and upper portion, said cassette including a second side portion having a panel secured thereto, a bar secured in said groove and including at least one projection extended therefrom for engaging with said at least one notch of said cassette so as to allow said bar to be stably secured in place and so as to prevent said bar from moving along said groove, said bar including a side edge having a longitudinal flange extended upward therefrom for engaging with and for stably retaining the nails in place, a cap secured to said first side portion of said cassette, and a bracket formed integral on said rear and upper portion of said cassette for securing to the rear portion of the body, said upward extending longitudinal flange of said bar being provided for engaging with and for stably guiding the nails to move longitudinally along said slots so as to prevent said bar from being easily worn out and so as to increase a working life of said bar and said cassette.

* * * * *